US008281624B2

(12) United States Patent
Rizzi

(10) Patent No.: US 8,281,624 B2
(45) Date of Patent: Oct. 9, 2012

(54) ANTI-SHOPLIFTING DEVICE FOR PROJECTING HOLDERS

(75) Inventor: Daniel Rizzi, Luxembourg (LU)

(73) Assignee: Designer Club SRL, Varese (IT)

( * ) Notice: Subject to any disclaimer, the term of this patent is extended or adjusted under 35 U.S.C. 154(b) by 335 days.

(21) Appl. No.: 12/516,436

(22) PCT Filed: Nov. 27, 2007

(86) PCT No.: PCT/EP2007/062906

§ 371 (c)(1),
(2), (4) Date: Dec. 18, 2009

(87) PCT Pub. No.: WO2008/065126

PCT Pub. Date: Jun. 5, 2008

(65) Prior Publication Data

US 2010/0170307 A1 Jul. 8, 2010

(30) Foreign Application Priority Data

Nov. 27, 2006 (EP) ..... 06124852

(51) Int. Cl.
*E05B 73/00* (2006.01)

(52) U.S. Cl. ..... 70/14; 70/57.1; 70/58; 70/63; 211/7; 292/86; 292/303; 292/DIG. 38

(58) Field of Classification Search ..... 70/14, 57, 70/57.1, 58–63, 140; 211/4, 7; 292/80, 86, 292/303, 95, 121, 127, 128, 258, 288, 298, 292/295, 292, 296, DIG. 37, DIG. 38
See application file for complete search history.

(56) References Cited

U.S. PATENT DOCUMENTS

| | | | | | |
|---|---|---|---|---|---|
| 1,088,917 | A | * | 3/1914 | Meledonian | 70/70 |
| 2,020,879 | A | * | 11/1935 | Eldred | 70/267 |
| 2,500,375 | A | * | 3/1950 | Parker | 70/232 |
| 3,992,906 | A | * | 11/1976 | Huddleston | 70/18 |
| 3,999,409 | A | * | 12/1976 | Bell | 70/58 |
| 4,096,715 | A | * | 6/1978 | Lipschutz | 70/59 |
| RE30,523 | E | * | 2/1981 | Rich | 70/58 |

(Continued)

FOREIGN PATENT DOCUMENTS

EP 1557365 7/2005

(Continued)

OTHER PUBLICATIONS

International Search Report from corresponding PCT Application No. PCT/EP2007/062906 mailed Oct. 6, 2008.

*Primary Examiner* — Lloyd Gall
(74) *Attorney, Agent, or Firm* — Lando & Anastasi, LLP

(57) ABSTRACT

There is disclosed an anti-shoplifting device for projecting holders (4), in particular for the display of blister packs, comprising a first (1) and a second body (2), which are mutually movable between a locked position, in which they define an opening (21) for the passage of a hooked projecting holder, ensured by locking assembly (8, 9, 10), and an unlocked position achieved by unlocking assembly (12, 13, 14, 15) acting on the locking assembly (8, 9, 10). The locked and unlocked positions are such that the device is respectively hooked or removable from the projecting holder (4). Further, the first and second bodies (1, 2) are rotateably coupled in a separable manner by a rotating structure.

10 Claims, 6 Drawing Sheets

U.S. PATENT DOCUMENTS 4,289,242 A * 9/1981 Kenyon ..... 211/4
4,296,615 A * 10/1981 Zoor ..... 70/19
4,907,111 A * 3/1990 Derman ..... 360/97.02
5,027,622 A * 7/1991 Hatch et al. ..... 70/14
5,191,314 A * 3/1993 Ackerman et al. ..... 340/542
5,193,366 A * 3/1993 Brinkman ..... 70/18
5,259,220 A * 11/1993 Fredrickson ..... 70/14
5,746,074 A * 5/1998 Collins ..... 70/18
6,802,193 B1 * 10/2004 Long ..... 70/207
7,197,902 B1 * 4/2007 Barkdoll ..... 70/57.1
2002/0130235 A1 9/2002 Tong
2004/0084386 A1 * 5/2004 Huehner et al. ..... 211/4
2006/0157431 A1 * 7/2006 Nagelski et al. ..... 211/54.1
2009/0057244 A1 * 3/2009 Conti et al. ..... 211/7

FOREIGN PATENT DOCUMENTS

WO 2005100722 10/2005

* cited by examiner

ANTI-SHOPLIFTING DEVICE FOR PROJECTING HOLDERS

BACKGROUND OF THE INVENTION (1) Field of the Invention.

The present invention relates to an anti-shoplifting device for projecting holders.

(2) Description of Related Art.

A lot of products of limited dimensions and weight are packaged in such a way to be able to hang them on projecting holders.

This enables greater visibility to be given to the product and the display space to be better exploited inside shops, supermarkets, shopping malls, etc.

In practical terms, the packaging of such products comprises a drilled upper portion, for example a through opening suitable for coupling with a projecting holder that can provide a single rod or a pair of parallel rods for better support.

Although of small dimensions, said products have a certain commercial value, so they are often the objective of thieves. Razor blades for men, for example, are costly in relation to the dimensions thereof, so that many supermarkets, following continuous thefts, do not even display them and supply them to the customer only if requested at the checkout counters.

The alarm sensors of the packages are easily evaded by breaking open the package and removing the products.

The thief can easily remove thousands of products such as razor blades for men, using a simple bag. The same considerations apply to batteries, accessories for mobile phones and the like. Normally, these products are all near the checkout counters, they are sometimes even hidden, as in the case of razor blades for men.

Anti-shoplifting devices are known to be coupled with the projecting holder in such a way as to prevent the removal of the package, for example a blister pack.

A first type of known device consists of a box body with an opening for the passage of the projecting holder, and bolt means for fixing the device to the holder. An external operating member enables the device to be locked and unlocked. It is substantially a type of padlock. This device has the drawback of providing a relatively complex opening/closing device for a device of limited dimensions, said mechanism adding greatly to the weight of the anti-shoplifting device and ensuring a not insignificant cost for each projecting holder.

An anti-shoplifting device is further known that consists of a box body comprising a pair of shells connected by means of a hinge that enables the shells to rotate mutually by about 180°, namely between a closing position in which the shells are superimposed and an open position in which the shells are at 180° in relation to one another.

A "snap" locking means ensures the closure of the device, an external key being provided to unlock the device.

The link between the two shells by means of the hinge limits the maneuverability of the device and therefore the hooking/unhooking rapidity to and from the projecting holder. As the operator is asked to interact often with said device, let the reader think, for example, of the number of people who wish to purchase a packet of razor blades for men in a normal supermarket over the course of a day, convenience of use takes on a fundamental and certainly not insignificant role.

On the one hand, the hinge enables the two shells to be centred in an optimal manner during the closing step (for "snap" locking, centring is essential).

Lastly, anti-shoplifting devices are known comprising two separate couplable parts fixed in a locked position, or coupled substantially by means of a bolt locking mechanism with the drawbacks arising therefrom that have been illustrated above.

BRIEF SUMMARY OF THE INVENTION

The object of the present invention is to make a anti-shoplifting device for projecting holders that is of simple concept, is easy to operate, light, compact and economic, that overcomes the drawbacks of the aforesaid known anti-shoplifting devices.

According to this invention, this object is achieved with an anti-shoplifting device for projecting holders, in particular for the display of blister packs, comprising a first and second bodies, preferably shells that are mutually movable between a locked position, in which they define an opening for the passage of the hooked projecting holder, ensured by locking means, and an unlocked position achieved by unlocking means acting on said locking means, said locked and unlocked position being such that the device is respectively hooked or removable from the projecting holder, characterised in that said first and second bodies are rotatably coupled in a separable manner by means of rotation.

Rotatable coupling occurs through a rotatable coupling means that ensures centring of the two bodies.

Said bodies are preferably shells, thus becoming the box device. Alternatively, other shapes may be contemplated for the device, such as ellipsoidal, cylindrical, or cubic.

BRIEF DESCRIPTION OF SEVERAL VIEWS OF THE DRAWING(S)

These and other features of the present invention will be made clearer by the following detailed description of a practical embodiment thereof given by way of non-limitative example in the attached drawings, in which.

DETAILED DESCRIPTION OF THE INVENTION

Figure 1:
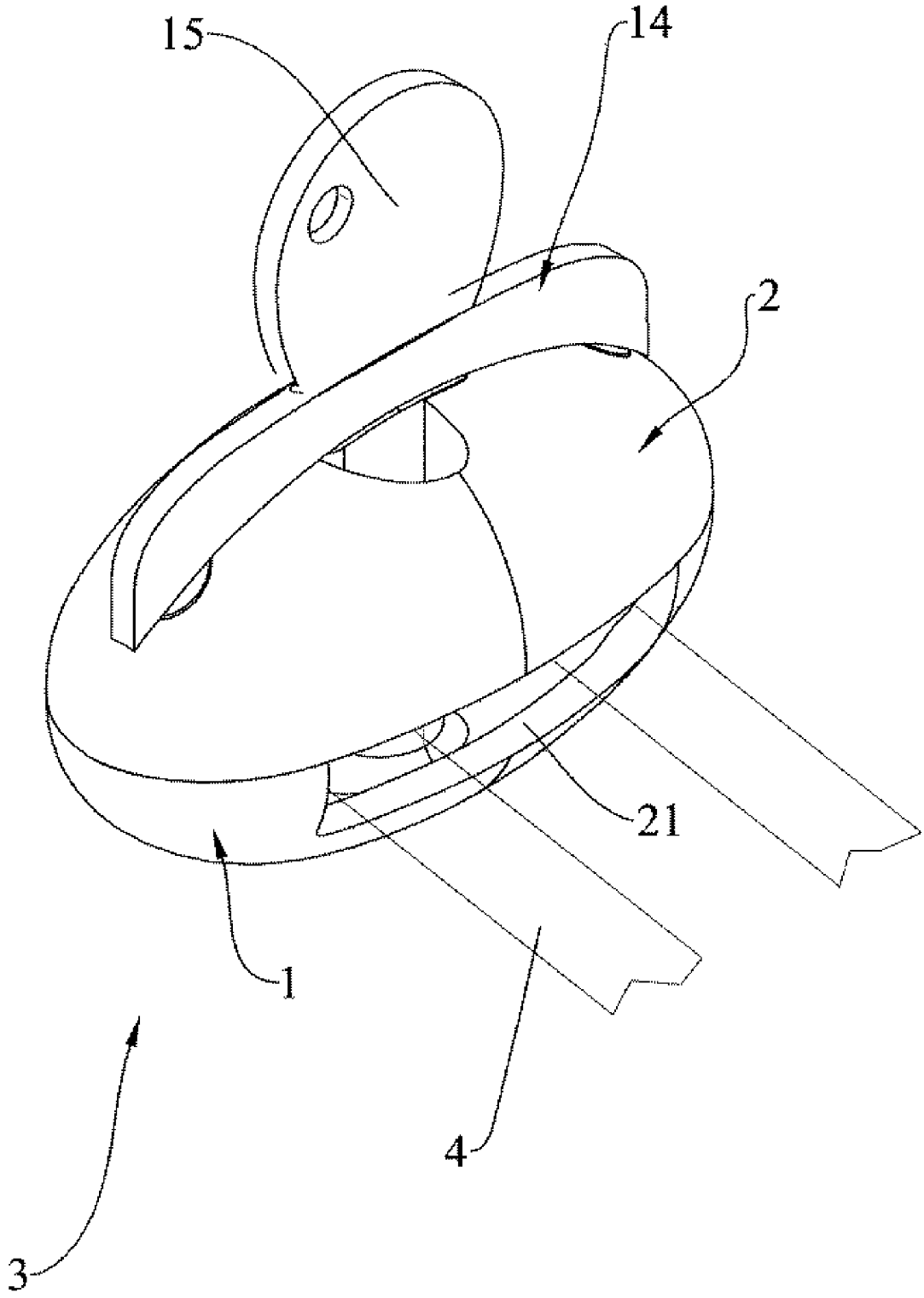
FIG. 1 shows a perspective view of an anti-shoplifting device according to the present invention.

An anti-shoplifting box device 3 for projecting holders 4, in particular for displaying blister packs, comprises (FIG. 1) a first shell 1 rotatably coupled with a second shell 2, and an opening 21 for the passage of the projecting holder 4.

Said first shell 1 comprises a coupling pivot 5 (FIG. 2) having a shaped end 6 rotatably couplable with a coupling guide 7 of the second shell 2, said guide 7 being housed in a hole 20.

Figure 2:
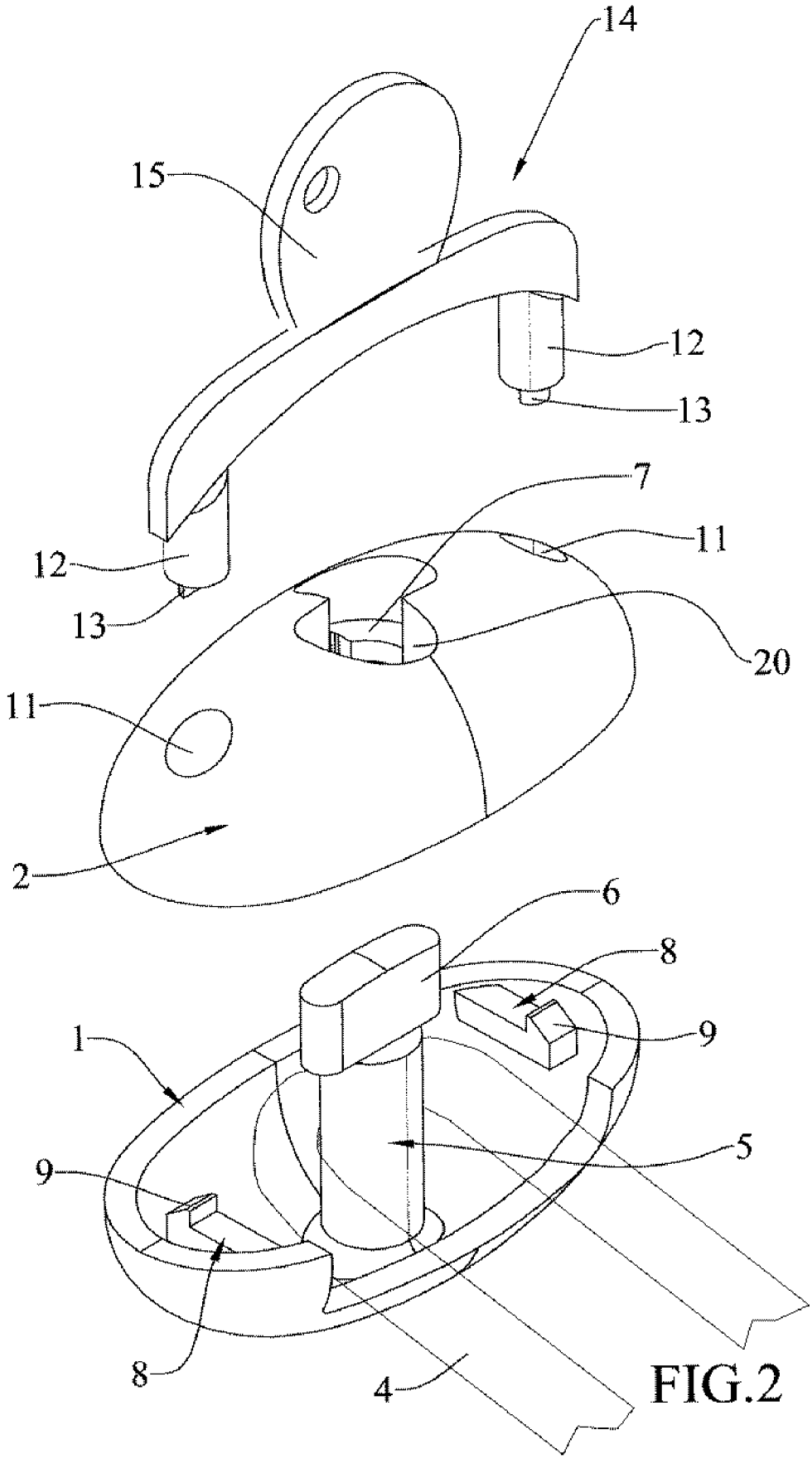
FIG. 2 shows a perspective view of the exploded device in FIG. 1, i.e. with the shells separated for disengagement from the projecting holder.
Figure 3:
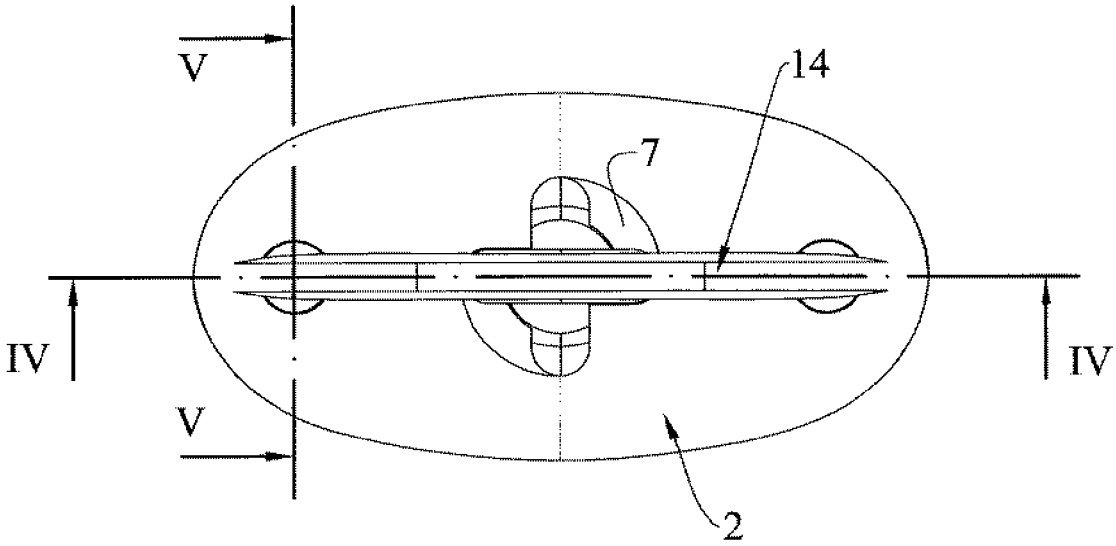
FIG. 3 shows a plan view from above of the device in FIG. 1.
Figure 4:
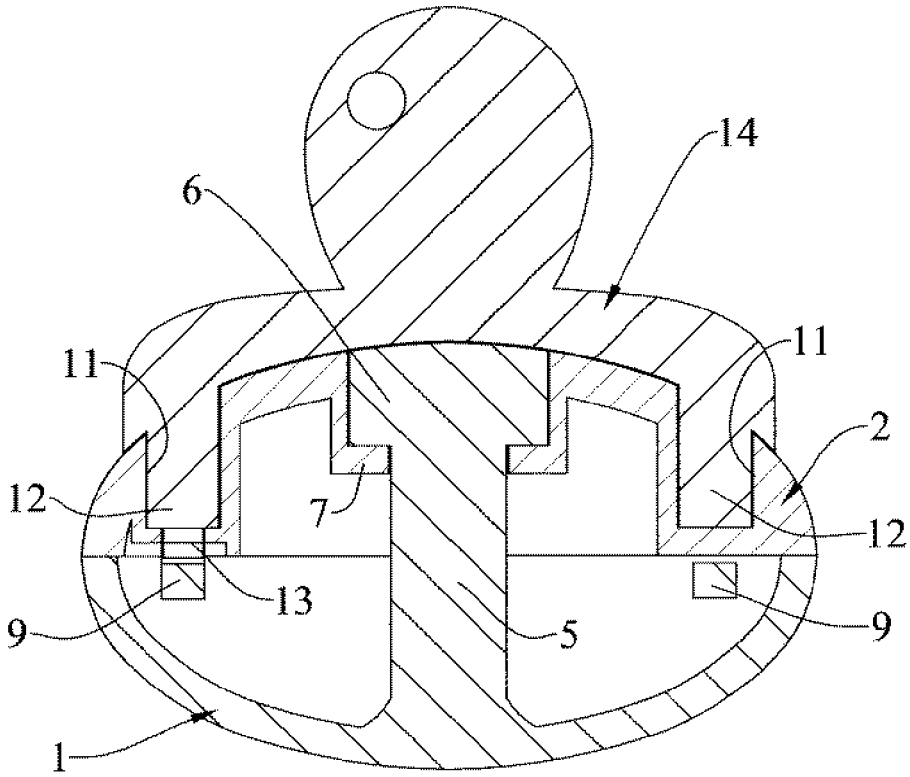
FIG. 4 shows a section view according to the line IV-IV of FIG. 3.
Figure 7:
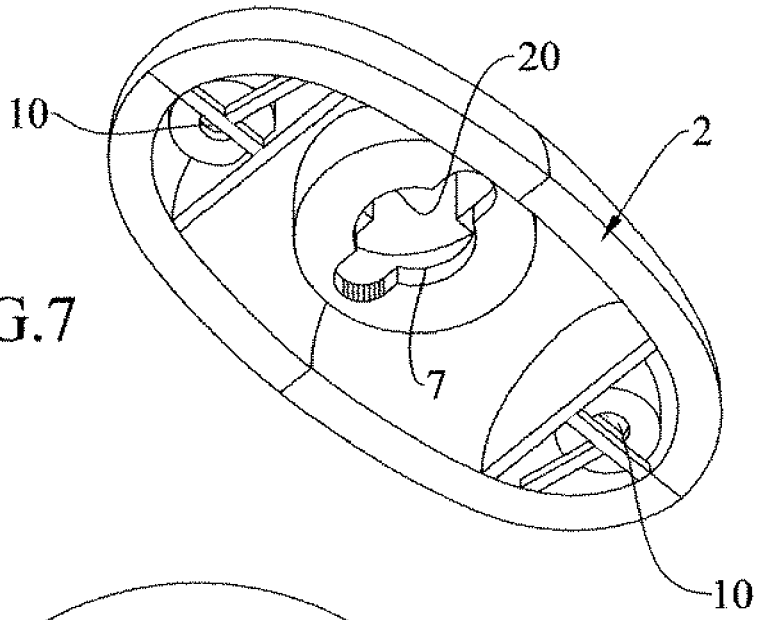
FIG. 7 shows a perspective view from below of a shell.
Figure 8:
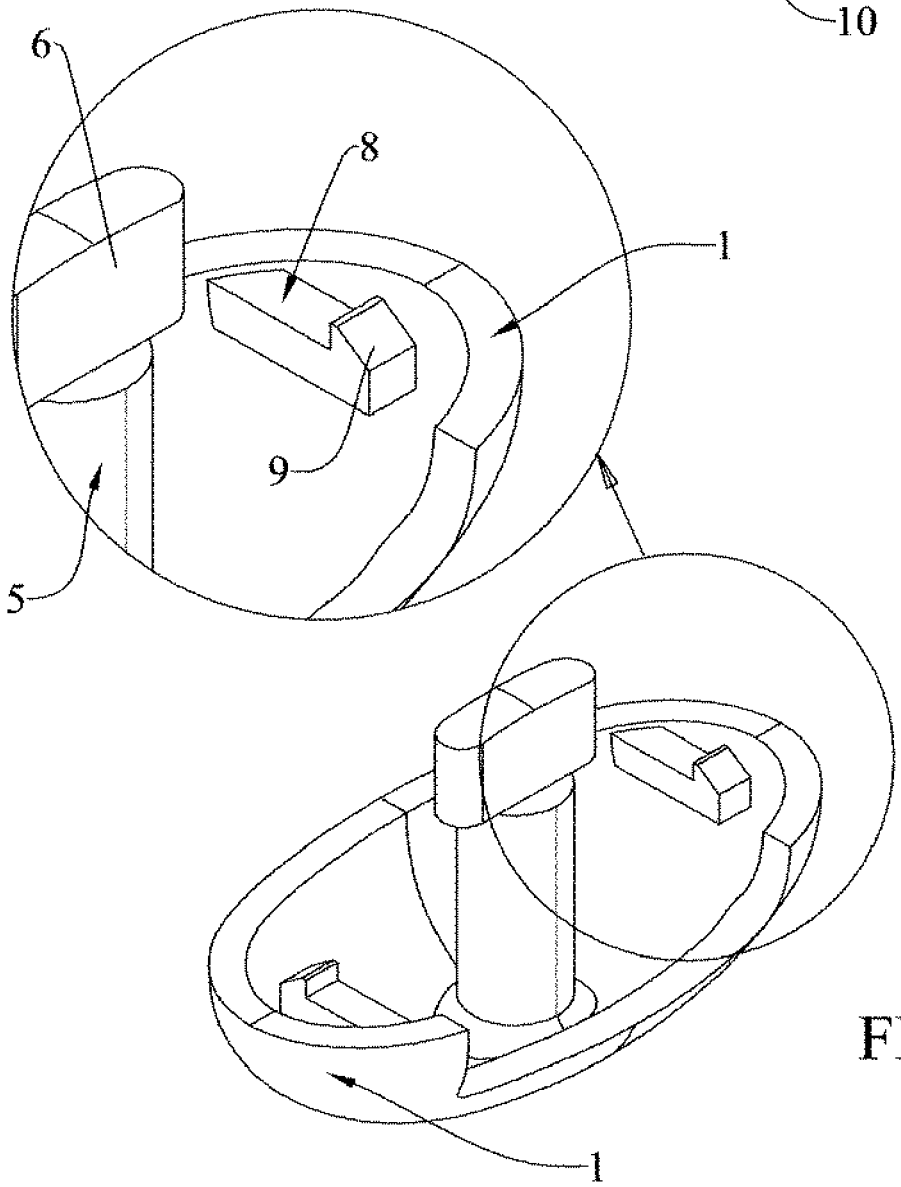
FIG. 8 shows a perspective view from above of the other shell with a detail on an enlarged scale.
Figure 9:
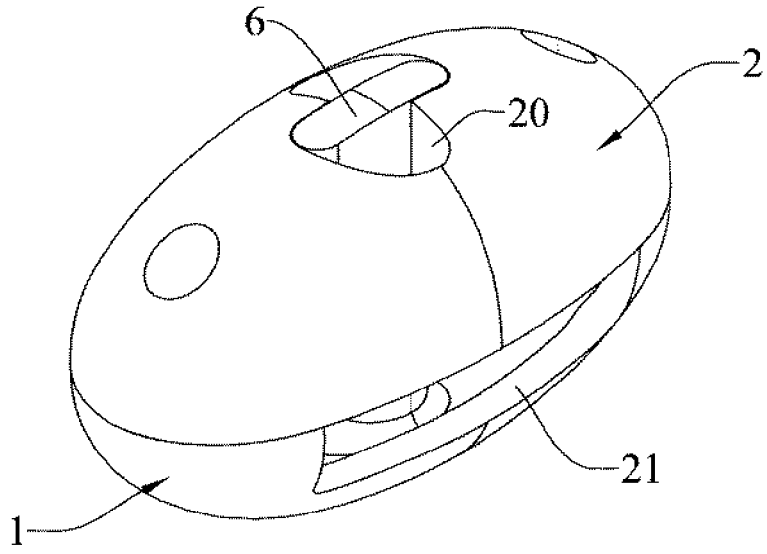
FIG. 9 shows a perspective view of the device in the locked position.

The first shell 1 further comprises latches 8 that are slightly deformable elastically with a lug 9 for coupling with locking seats 10 of the second shell 2 (FIG. 7), which further comprises through holes 11 for inserting the unlocking pins 12 with protrusions 13 of a dual-action key 14 having a grip 15 (FIGS. 2 and 4).

With regard to the operation of the device 3, it will first be considered unhooked from the projecting holder 4 (FIG. 2).

The shells 1, 2 are positioned at about 90° from one another, taking care that the end of the projecting holder 4 embraces the coupling pivot 5 (FIG. 2).

The hole 20 is shaped in such a way as to have a portion that enables the end 6 and a portion with the guide 7 for coupling to be inserted.

The shaped end 6 then engages with the coupling guide 7, then rotating the shells 1, 2 with respect to one another until they are completely aligned, i.e. until the hooking ends 9 couple with the seats 10 mutually locking the shells 1, 2 (FIG. 1).

In this position, the anti-shoplifting device 3 cannot be removed from the projecting holder 4, the held blister packs thus not being removable.

Figure 5:
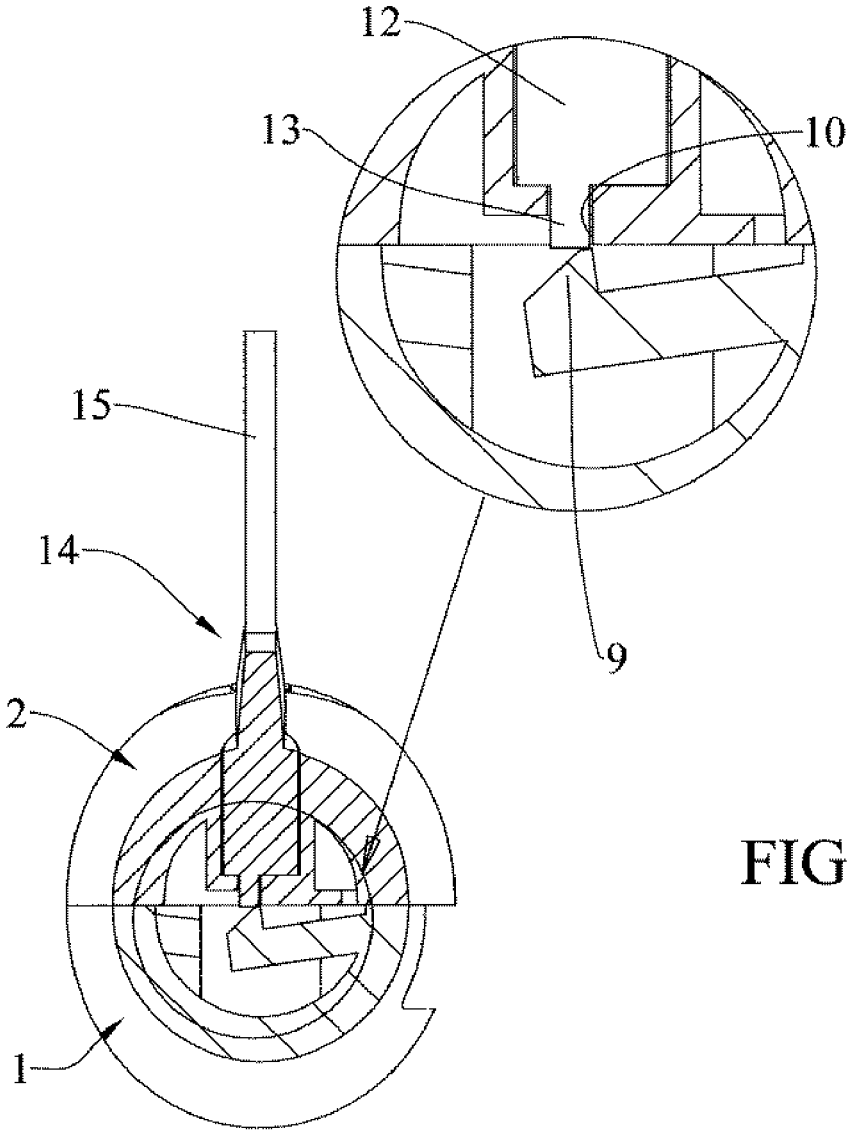
FIG. 5 shows a section view according to the line V-V of FIG. 3 with a detail on an enlarged scale.
Figure 6:
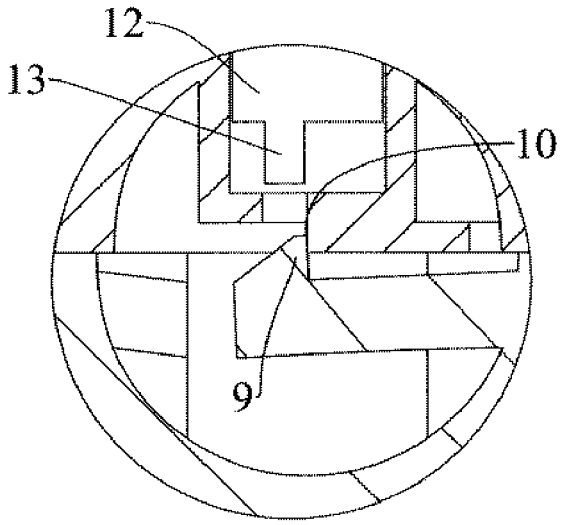
FIG. 6 shows the enlarged detail of FIG. 5 with the shells in the locked position.

In order to unlock the shells 1, 2, it is sufficient to insert the unlocking pins 12 of the key 14 into the through holes 11 until the protrusions 13 interact with the hooking ends 9 (FIG. 5).

By pressing the key 14 against the device 3, the latches 8 are deformed, disengaging the hooking ends 9 from the seats 10.

Figure 10:
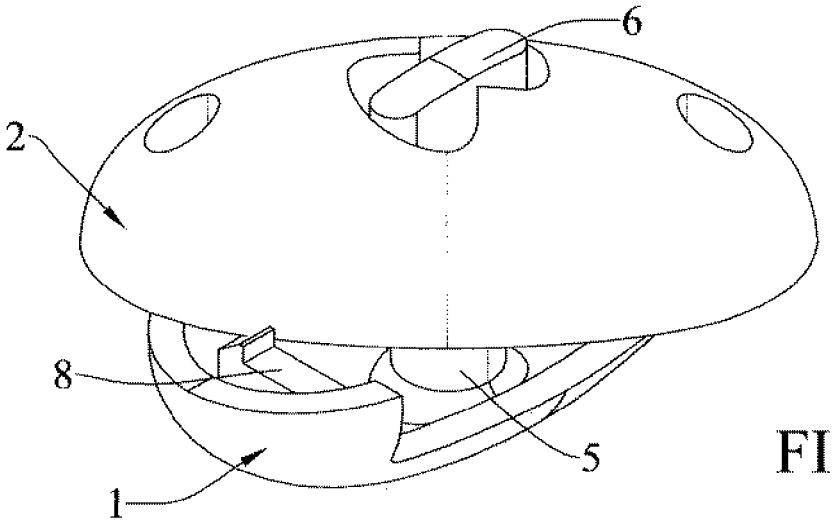
FIG. 10 shows a perspective view of the device in an unlocked position.
Figure 11:
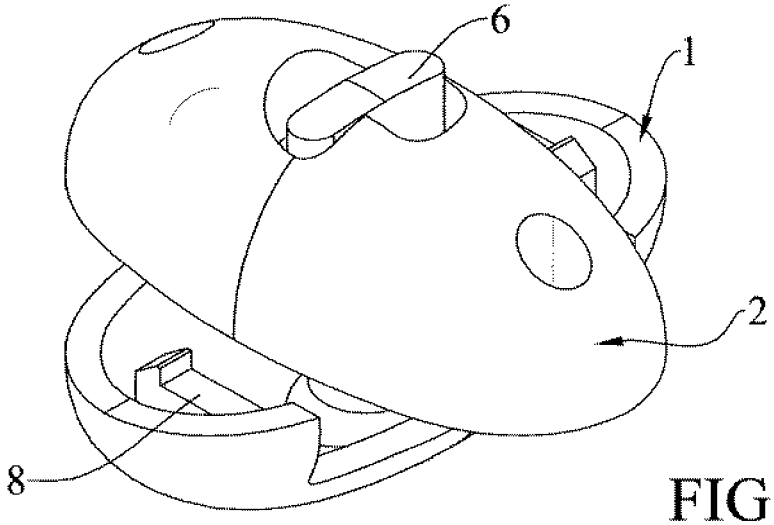
FIG. 11 shows a perspective view of the device in a further unlocked position subsequent to the preceding one, the shells being in this position separable for disengagement from the projecting holder.

The two shells are now free to rotate mutually until they assume the position of FIG. 11, i.e. 90° . It is now possible to separate them, thus uncoupling the device 3 from the projecting holder 4. The blister packs can be removed from the projecting holder 4 (FIGS. 10, 11).

Substantially, the mutual rotational motion of the two shells 1, 2 is exploited to lock the shells 1, 2 and unlock them with the help of the key 14.

The coupling latch 8 and the coupling guide 7 permit perfect centring of the shells 1, 2, ensuring the engagement between the hooking ends 9 and the respective seats 10.

A key 14 that is not single but dual action enables unlocking only with a double pin 12 the actions of which have to be synchronised; two separate pins or the like make opening very difficult, if not impossible, so that the thief has to be provided with a very particular, certainly not common key.

The disclosed device 3 is very light, the locking means 8, 9, 10 being very reduced and therefore taking up little space. Maneuverability is excellent thanks to the rotatable coupling means 5, 6, 7 that is absolutely essentially and therefore not constructively complex.

Said shells 1, 2 can be simple rotatably couplable bodies according to the invention. The shells 1, 2 in fact give the device 3 a box shape for being able to contain the end portion of the projecting holder 4. Alternatively, other shapes may be contemplated for device 3, such as ellipsoidal, cylindrical, or cubic. Said end of the projecting holder 4 may remain outside the device 3, which would thus have a through opening 21, in a locked position, the pivot 5 preventing the disengagement of the device 3 from the hooked projecting holder 4.

The invention claimed is:

1. An anti-shoplifting device for projecting holders comprising:

a first body and a second body, that in a locked position define an opening for passage of the projecting holder, the first and the second bodies comprising a locking assembly, which provides the locked position of the first and second bodies, the device further comprising an unlocking assembly that acts on the locking assembly to provide an unlocked position of the first and second bodies; a rotating structure for facilitating rotatable coupling of the first and second bodies in a separable manner between the locked position and the unlocked position; and wherein said locking assembly comprises at least one elastically deformable locking protuberance with a lug suitable for coupling with at least one notch, said coupling occurring after a corresponding rotating motion between said bodies.

2. The device according to claim 1, wherein said first body comprises a coupling element suitable for rotatably coupling with a coupling guide of said second body.

3. The device according to claim 2, wherein said first body comprises a coupling pivot with shaped end suitable for rotatably coupling with a coupling guide of said second body.

4. The device according to claim 1, wherein said at least one elastically deformable locking protuberance comprises at least one small locking latch.

5. The device according to claim 1, wherein said unlocking assembly further comprises an unlocking key having unlocking pins, wherein said second body comprises at least one through hole for inserting the unlocking pins of the unlocking key.

6. The device according to claim 1, wherein said locking assembly comprises two locking latches and two corresponding notches.

7. The device according to claim 1, wherein said device is any of box-shaped, ellipsoidal, cylindrical, or cubic.

8. The device according to one of claims 5 and 6, wherein the unlocking assembly further comprises an unlocking key having a grip suitable for interacting with the locking assembly.

9. The device according to claim 8, wherein said key comprises at least one unlocking pin having a protrusion suitable for interacting with a lug.

10. The device according to claim 9, wherein said key comprises a dual-action unlocking key , comprising a pair of unlocking pins having protrusions suitable for interacting with the locking assembly.

* * * * *